US010774523B2

(12) United States Patent
Reuter

(10) Patent No.: US 10,774,523 B2
(45) Date of Patent: Sep. 15, 2020

(54) BRACE INSERT DEVICE USED IN THE CONSTRUCTION OF CONCRETE PANELS

(71) Applicant: Reubart Enterprises, LLC, Tyrone, GA (US)

(72) Inventor: Jason M. Reuter, Atlanta, GA (US)

(73) Assignee: Reubart Enterprises, LLC, Tyrone, GA (US)

( * ) Notice: Subject to any disclaimer, the term of this patent is extended or adjusted under 35 U.S.C. 154(b) by 0 days.

(21) Appl. No.: 16/270,842

(22) Filed: Feb. 8, 2019

(65) Prior Publication Data

US 2019/0242113 A1 Aug. 8, 2019

Related U.S. Application Data

(60) Provisional application No. 62/627,791, filed on Feb. 8, 2018.

(51) Int. Cl.

| | |
|---|---|
| ***E04G 21/14*** | (2006.01) |
| ***E04G 15/04*** | (2006.01) |
| ***E04B 1/41*** | (2006.01) |
| ***E04G 21/26*** | (2006.01) |

(52) U.S. Cl.

CPC ..... *E04B 1/41* (2013.01); *E04G 21/26* (2013.01); *E04G 15/04* (2013.01); *E04G 21/142* (2013.01)

(58) Field of Classification Search

CPC ..... E04B 1/41; E04B 1/4114; E04B 1/4121; E04B 1/4128; E04B 1/4135; E04B 1/4157; E04B 2001/4192; E04G 21/26; E04G 21/142; E04G 15/04; E04G 21/185; B28B 23/005

USPC ..... 52/698, 125.4, 712; 405/259.5

See application file for complete search history.

(56) References Cited

U.S. PATENT DOCUMENTS

| | | | | | |
|---|---|---|---|---|---|
| 1,405,994 | A * | 2/1922 | Fisher | E04B 1/4135 | 52/710 |
| 3,216,171 | A * | 11/1965 | Jenkins | E04B 1/4121 | 52/127.3 |
| 3,404,503 | A * | 10/1968 | Courtois | B28B 23/005 | 52/701 |
| 3,420,014 | A * | 1/1969 | Courtois | E04B 1/4142 | 52/125.4 |
| 3,431,012 | A * | 3/1969 | Eriksson | B28B 23/005 | 294/89 |
| 3,456,547 | A * | 7/1969 | Strong | E04B 1/4121 | 411/105 |
| 3,590,538 | A * | 7/1971 | Holt | E04B 1/4121 | 52/127.3 |
| 3,596,971 | A * | 8/1971 | Courtois | B28B 23/005 | 294/89 |

(Continued)

*Primary Examiner* — Kyle J. Walraed-Sullivan

(74) *Attorney, Agent, or Firm* — Honigman LLP

(57) ABSTRACT

A brace insert device that is configured to be cast in concrete includes an anchor insert that has a hub with a threaded inner surface and a plurality of legs extending from the hub. A fastener has a shank portion that is threadably engaged with the threaded inner surface of the hub, where a head portion of the fastener is coupled to an end of the shank portion. A cap has an inner surface that is disposed over and conceals the head portion of the fastener. The cap is configured to be removed from a cured concrete structure to expose and allow operable access to the head portion of the fastener for use in attaching a wall brace.

17 Claims, 6 Drawing Sheets

(56) References Cited

U.S. PATENT DOCUMENTS

| | | | | | |
|---|---|---|---|---|---|
| 3,705,469 | A * | 12/1972 | Eriksson | B28B 23/005 | 52/125.4 |
| 4,000,591 | A * | 1/1977 | Courtois | B28B 23/005 | 52/689 |
| 4,074,499 | A * | 2/1978 | Mess | E04B 1/4121 | 52/705 |
| 4,084,362 | A * | 4/1978 | Piazza | E04B 1/4121 | 52/309.12 |
| 4,179,151 | A * | 12/1979 | Tye | E04G 21/142 | 294/89 |
| 4,679,362 | A * | 7/1987 | Mess | E04G 21/142 | 52/125.5 |
| 5,242,249 | A * | 9/1993 | Grayson | E04B 1/4121 | 405/284 |
| 9,347,232 | B1 * | 5/2016 | Francies, III | E04G 21/142 | |
| 10,060,144 | B1 * | 8/2018 | Francies, III | E04G 21/10 | |
| 2002/0070322 | A1 * | 6/2002 | Zambelli | E04G 21/142 | 248/200 |
| 2003/0140575 | A1 * | 7/2003 | Sanftleben | E04G 15/04 | 52/125.4 |
| 2004/0168375 | A1 * | 9/2004 | Sack | E04B 1/4121 | 52/125.4 |
| 2007/0176062 | A1 * | 8/2007 | Connell | E04G 15/04 | 248/153 |
| 2010/0186313 | A1 * | 7/2010 | Stanford | E02D 35/00 | 52/125.1 |
| 2017/0247232 | A1 * | 8/2017 | Hansort | E04G 15/04 | |
| 2017/0247892 | A1 * | 8/2017 | Hansort | E04B 1/20 | |
| 2018/0023296 | A1 * | 1/2018 | Recker | E01O 5/001 | 52/126.6 |

* cited by examiner

BRACE INSERT DEVICE USED IN THE CONSTRUCTION OF CONCRETE PANELS

CROSS-REFERENCE TO RELATED APPLICATION

This application claims benefit and priority under 35 U.S.C. § 119(e) of U.S. provisional application Ser. No. 62/627,791, filed Feb. 8, 2018, which is hereby incorporated herein by reference in its entirety.

TECHNICAL FIELD

The present disclosure relates to a brace insert used during the construction of tilt-up and precast concrete wall panels.

BACKGROUND

Concrete panels are used in concrete and precast wall construction, and are typically used to construct commercial buildings, such as warehouses and factories. A concrete panel is constructed with reinforcement and concrete. The construction involves building a rectangular concrete form on site in the case of tilt-up, and off site in the case of precast wall construction. Steel reinforced rebar or other reinforcement is mounted in the form, the form is filled with concrete, and after the concrete cures, the concrete panel is properly aligned creating a wall section. Numerous wall sections generally are fabricated and attached together to frame members of the building to construct complete walls. Utility conduits may be embedded within the wall sections as needed to provide electricity and plumbing. The forms into which the concrete is poured are typically fabricated from wood or metal and, for tilt-up panels, they are formed at a worksite on the ground adjacent to the location where the wall is constructed.

Brace inserts are commonly cast in tilt-up or precast concrete wall panels. The brace inserts are typically cast into the wall panels with a plastic plug, which is later removed during placement of the panel. Once the plug is removed from the insert cast into the wall panel, a metal brace coil bolt is then inserted for a shoe of a wall brace to be attached to the wall panel. With the wall brace attached to the brace insert, the wall brace is used to impart rigidity to the wall panel while the building is being constructed. Plastic plugs are often stripped or torn apart when removing the plug, which can hinder or prevent secure insertion of the bolt.

SUMMARY

The present disclosure provides a brace insert device that is adapted to be cast in a concrete structure, such as a tilt-up or precast wall panel or a floor panel. The brace insert device is used as an anchor point for a wall brace that supports a concrete wall panel during a building construction. The brace insert device provides a fastener, such as a bolt, that is integrated with an anchor insert at the time of casting the brace insert device in liquid concrete. The integrated fastener is threadably engaged with a hub of the embedded anchor insert, such that the threaded engagement of the fastener is not disrupted by liquid concrete during forming of the concrete structure. The brace insert device may use a cap that is disposed over a head portion of the fastener, such that the cap may be removed from a cured concrete structure to expose and allow operable access to the head portion of the fastener for use in partially unscrewing the fastener from the anchor insert and thereby allowing a wall brace to attach to the brace insert device. Such integration of a fastener with the brace insert device during the time of casting the concrete structure prevents liquid concrete from interfering with the threads and corresponding threaded engagement of the fastener and the anchor insert.

According to one aspect of the present disclosure, a brace insert device that is configured to be cast in concrete includes an anchor insert that has a hub with a threaded inner surface and a plurality of legs extending from the hub. A fastener has a shank portion that is threadably engaged with the threaded inner surface of the hub, where a head portion of the fastener is couple to an end of the shank portion. A cap has an inner surface that is disposed over and conceals the head portion of the fastener. The cap is configured to be removed from a cured concrete structure to expose and allow operable access to the head portion of the fastener for use in attaching a wall brace. The inner surface of the cap may include a cavity that is configured, such as with a hexagonal shape, to receive the head portion of the fastener.

According to another aspect of the present disclosure, a brace insert device that is configured to be cast in concrete includes an anchor insert that has a coil with a threaded inner surface and a plurality of legs extending from the coil. The legs may extend at a generally equal length that is configured to position the coil at or near an exposed surface of a concrete structure. A fastener has a shank portion that is threadably engaged with the threaded inner surface of the coil and a head portion that is coupled to an end of the shank portion. A cap is disposed over the head portion of the fastener, where the cap is configured to act as a barrier from liquid concrete and to be removed from a cured concrete structure to allow operable access to the head portion of the fastener.

According to yet another aspect of the present disclosure, a brace insert device that is configured to be cast in concrete includes an anchor insert that has a hub and a plurality of legs extending from the hub. A fastener has a shank portion that is threadably engaged with an aperture of the hub. A cap is disposed over a head portion of the fastener, where the cap has at least one locating antenna that is configured to protrude from a cast concrete structure to locate the cap. Once located, the cap is configured to be removed from a cured concrete structure to expose and allow operable access to the head portion of the fastener for use in attaching a wall brace to the concrete structure.

These and other objects, advantages, purposes, and features of the present disclosure will become apparent upon review of the following specification in conjunction with the drawings.

DETAILED DESCRIPTION

Figure 1:
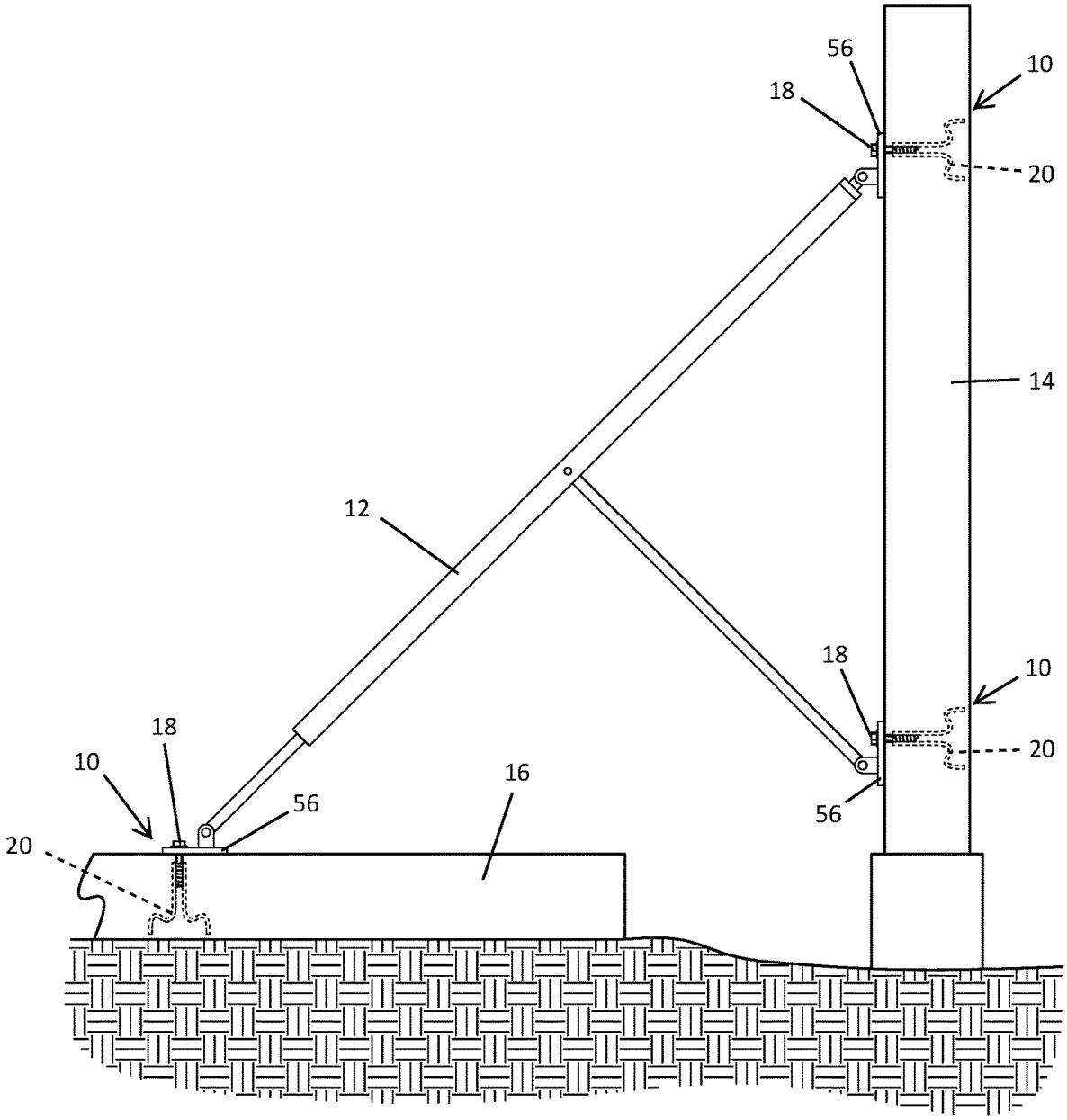
FIG. 1 is a side elevational view of brace insert devices embedded in a wall panel and a floor panel to engage a wall brace.

Referring now to the drawings and the illustrative embodiments depicted therein, a brace insert device 10 is embedded in a concrete structure to provide a secure attachment point for a wall brace 12 that is used to impart rigidity to an upright wall panel 14, such as for use while constructing a building. As shown in FIG. 1, the brace insert device 10 may be cast in multiple locations and in various concrete structures, such as a tilt-up or precast wall panel 14 or a floor panel 16 that is formed adjacent to a wall panel 14. In each placement location, the brace insert device 10 includes a fastener 18 that is integrated with and threadably engaged in an anchor insert 20 at the time of casting the brace insert device 10 in the liquid concrete that forms the corresponding concrete structure.

Figure 2:
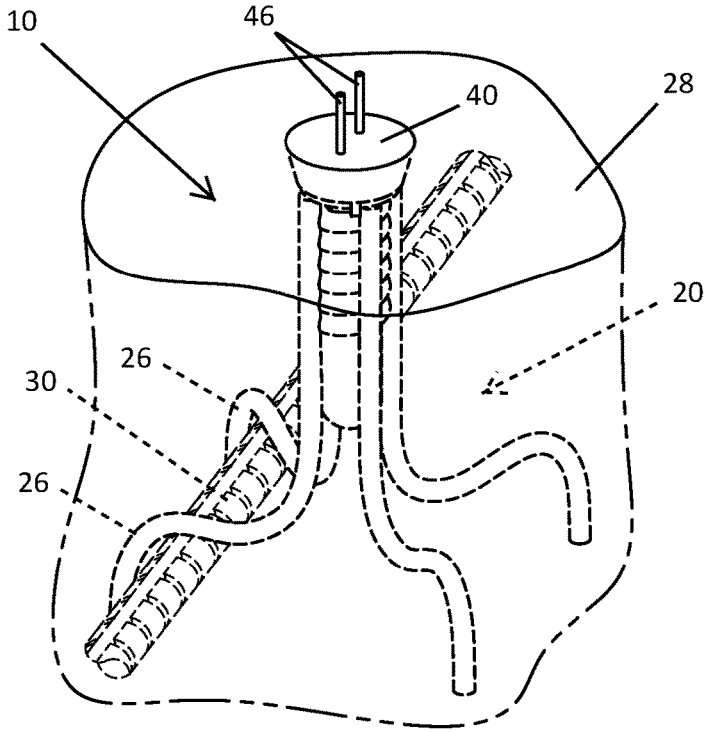
FIG. 2 is a perspective view of a brace insert device embedded in a concrete structure.

The anchor insert 20, such as shown in FIGS. 2-6, has a hub 22 with a threaded inner surface 24 for engaging the fastener 18 and a plurality of legs 26 that extend from the hub 22. The legs 26 may extend at a generally equal length or otherwise be configured to position the hub 22 at or near an exposed surface of the concrete structure, so as to allow the fastener 18 to be accessed from the exposed surface of the concrete structure. As shown in FIG. 2, the legs 26 extend downward from the hub 22 at a length and configuration that positions the hub 22 near the upper surface 28 of the concrete structure during formation and curing of the concrete. It is also conceivable that in another example of an anchor insert, the legs may initially extend upward from the hub before curving back downward, so as to position the hub near the lower surface of the concrete structure during formation and curing of a concrete panel, where the lower surface may be later exposed to access the hub when the panel is lifted and positioned.

Figure 3:
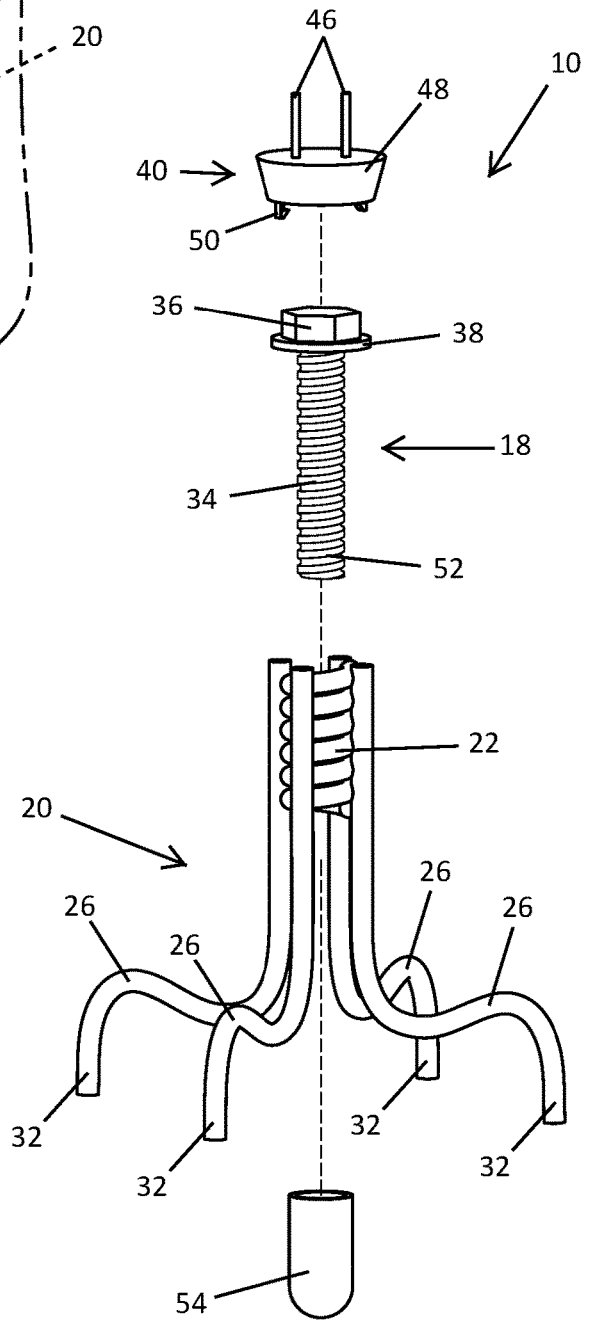
FIG. 3 is an exploded perspective view of the brace insert device shown in FIG. 2.
Figure 4:
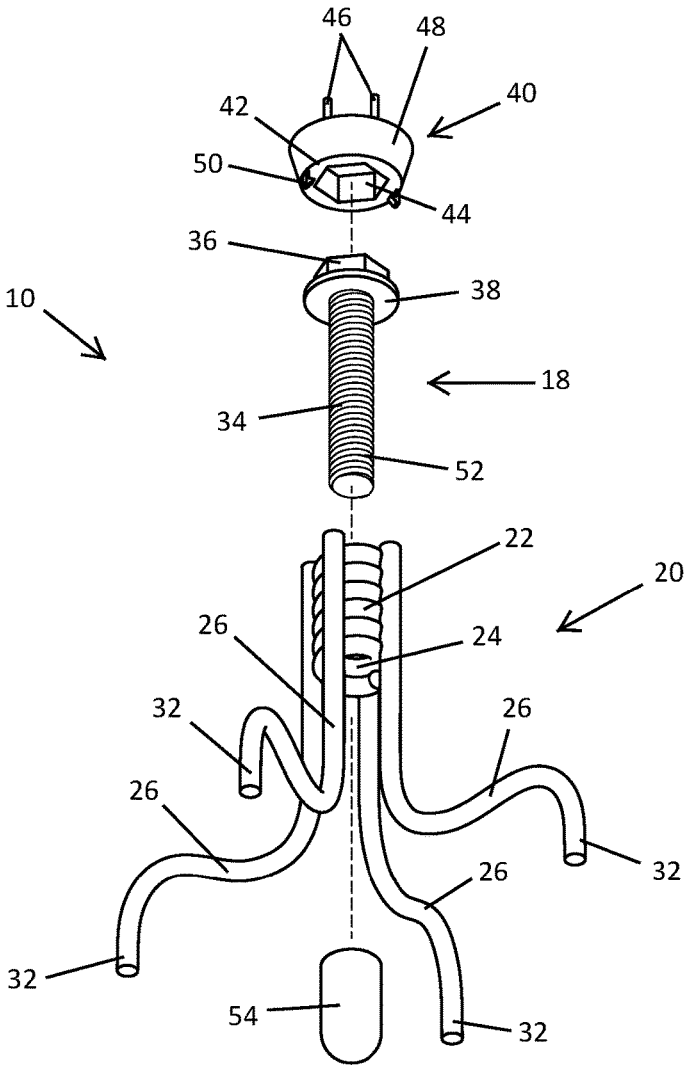
FIG. 4 is another exploded perspective view of the brace insert device, taken from an opposing end from that shown in FIG. 3.
Figure 5:
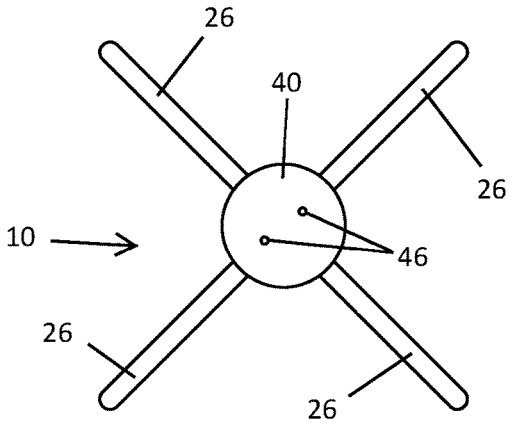
FIG. 5 is a top plan view of the brace insert device shown in FIG. 2.
Figure 6:
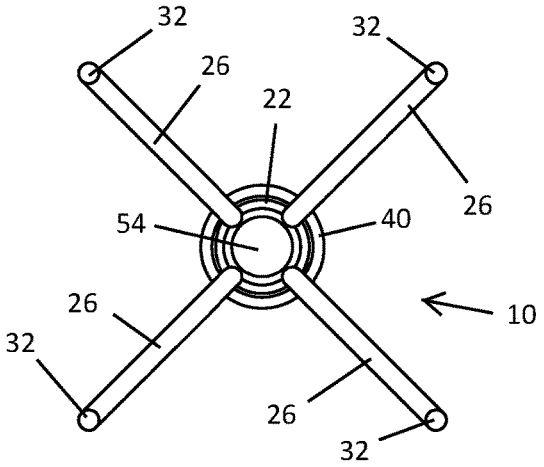
FIG. 6 is a bottom plan view of the brace insert device shown in FIG. 2.

As shown in FIGS. 2-6, the anchor insert 20 may have four legs 26 that are oriented perpendicular to each other, and may thus extend radially outward from the hub 22 at a generally equal radial spacing from each other, such as shown in FIGS. 5 and 6. However, it is contemplated that an anchor insert may include more or fewer legs and the legs of an anchor insert may have inconsistent spacing from each other. As shown in FIGS. 3 and 4, the legs 26 are attached to an outer surface of the hub 22 and extend downward and radially outward from the hub 22 in a sinuous shape. The curved shape of the legs 26 may allow one or more of the legs to overlap a reinforcing bar 30, such as shown in FIG. 2. The anchor insert 20 may also include feet 32 that are disposed at the distal ends of the legs 26 and depend downwardly to rest on the floor or base surface of the concrete form. The feet 32 may optionally include a protective tips or coating, such as a stainless steel dipped coating or polymer tip covers, such as to prevent rust or oxidation from occurring at the lower surface of the formed concrete panel, such as when it is lifted to for use as a wall panel.

The hub 22 of the anchor insert 20 may have a generally tubular shape with the threaded inner surface 24 extending along the central aperture of the tubular shape. As shown in FIGS. 3 and 4, the hub 22 may be a coil that is made from a metal wire formed in a tightly wound helical shape, where the threaded inner surface 24 may correspond with the wound shape of the coil. The legs 26 are attached to the hub 22, such as via welding to the outer surface of the coil. It is also understood that the hub may alternatively be a differently shaped receiver for the fastener, such as a ferrule or the like, with the treaded inner surface being machined or otherwise formed along the central aperture. Thus, the anchor insert may have various leg configurations and hub designs for the desired anchor location on the panel, corresponding panel dimensions, and desired load capabilities for the brace insert device.

As further shown in FIGS. 3 and 4, the fastener 18 that is integrated with the anchor insert 20 has a shank portion 34 that is threadably engaged with the threaded inner surface 24 of the hub 22. A head portion 36 of the fastener 18 is disposed at an end of the shank portion 34, so as to be operable for axially rotating the shank portion 34. The fastener 18, such as shown in FIGS. 3 and 4, may be a bolt that is provided with an orthogonal shaped head portion 36 and a collar 38 disposed between the head portion 36 and the threaded shank portion 34. In other words, the collar 38 may be a washer that is integrally formed at the head portion 36 of the bolt. The orthogonal shape head portion 36 is shown in FIG. 3 as a hexagonal shape. Specifically, the fastener 18 shown in FIGS. 3 and 4 is a metal brace coil bolt.

The integration of a fastener 18 with the brace insert device 10 during the time of casting the concrete structure prevents liquid concrete from interfering with the engaged threads of the fastener 18 and the anchor insert 20. Further, a cap 40 has an inner surface 42 that is disposed over and conceals the head portion 36 of the fastener 18. The cap 40 is configured to be removed from a cured concrete structure to expose and allow operable access to the head portion 36 of the fastener 18 for use in attaching a wall brace 12. The inner surface 42 of the cap 40 may include a cavity 44 that is configured, such as with a hexagonal shape, to matably receive the head portion 36 of the fastener 18.

The outer surface of the cap 40 may include a locating antenna 46 that is configured to protrude upward in a generally vertical orientation from an upper surface 28 of a concrete structure to locate the cap 40 and the fastener 18 when the concrete structure is cured, such as shown in FIG. 2. The antenna 46 may be integrally formed with the cap 40 and may comprise a flexible material that allows the antenna 46 to be flex, such as when contacted by a trowel or other tool when the upper surface of the concrete structure is screened or floated. As shown in FIG. 2, the cap 40 includes two locating antennas 46, although other examples of the cap may include more or fewer locating antenna. The cap 40 may comprise a plastic material, such as to allow for flexibility of the locating antenna 46 and molding of the shape of the cap 40, such as the hexagonal cavity 44 in the inner surface 42 of the cap 40.

Figure 8:
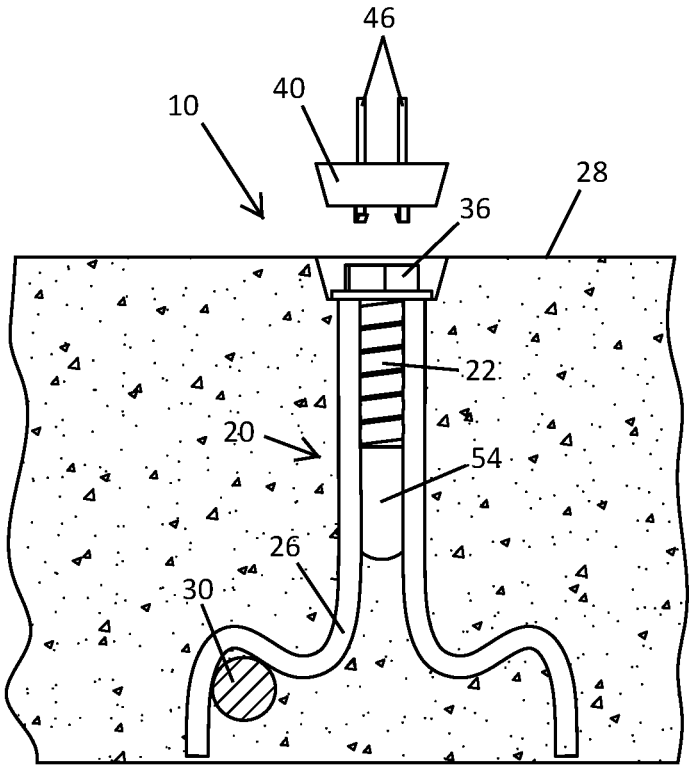
FIG. 8 is a cross-sectional side view of the brace insert device shown in FIG. 7, showing a cap removed to expose a head of a bolt integrated in the brace insert device.

Also, the cap 40 may have a tapered sidewall 48 extending between the inner and outer surfaces to prevent the cap 40 from being frictionally engaged in the concrete structure. As shown in FIGS. 3 and 4, the sidewall 48 of the cap 40 circumscribes the circular outer edges of the inner and outer surfaces to provide a tapered cylindrical shape. The tapered sidewall 48 is angled outward from the head portion 36 of the fastener 18, so that when the cap 40 is removed from the concrete structure, the cap 40 forms a cavity generally around the head portion 36 of the fastener 18, such as shown in FIG. 8.

The cap 40 may optionally include a connection member 50 that snap-fits the cap 40 to the head portion 36 of the fastener 18. As further shown in FIGS. 3 and 4, the two connection members 50 are provide on opposing sides of the cap 40. These connection members 50 each have a ramped surface that is configured to slide over the edge of the collar 38 to resiliently flex the connection members 50 radially outward and a shoulder engagement surface that snaps into engagement against the lower surface of the collar 38. The connection members 50 function to hold the cap 40 in close contact with the head portion 36 of the fastener 18 during formation of the concrete structure, so as to prevent the cap 40 from dislodging from the fastener 18, such as when the upper surface of the concrete structure is screed and floated.

Figure 7:
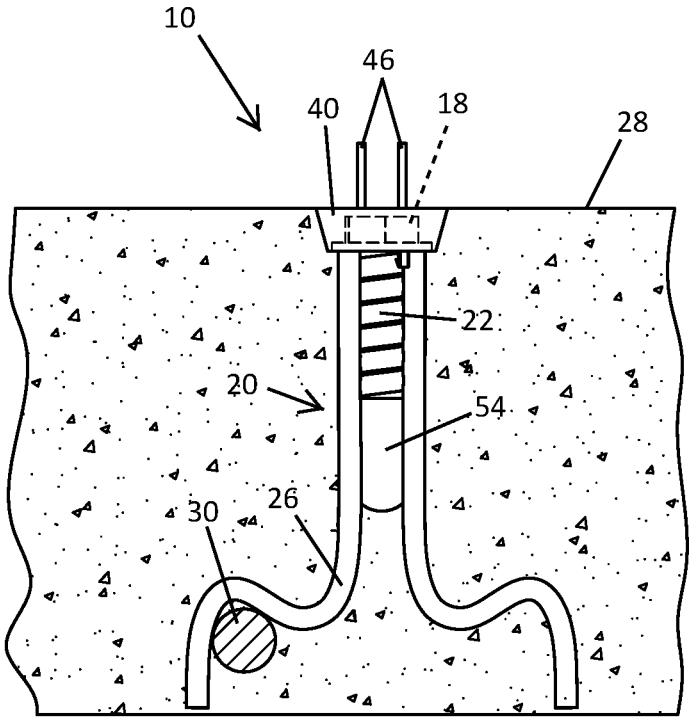
FIG. 7 is a cross-sectional side view of the brace insert device shown in FIG. 2.

When the fastener 18 is threaded into the anchor insert 20, the collar 38 of the fastener 18 may be moved near or into contact with the upper surface of the hub 22, such as shown in FIG. 7. Doing so may causes a distal end 52 of the shank portion 34 to protrude through the hub 22 and beyond the threaded inner surface 24 of the hub 22. As shown in FIGS. 3-10, a sleeve 54 may encase the exposed distal end 52 of the shank portion 34 that protrudes through the hub 22. The sleeve 54 is configured to protect the exposed surface of the shank portion 34 of the fastener 18 from being affixed to the cast concrete, so as to allow rotational operability of the fastener 18. The sleeve 54, such as shown in FIGS. 3 and 4, is has a tubular section and an enclosed end section, such as a rounded end, so as to cover all the exposed surfaces of the distal end 52 of the shank portion 34 of the fastener 18.

Figure 11:
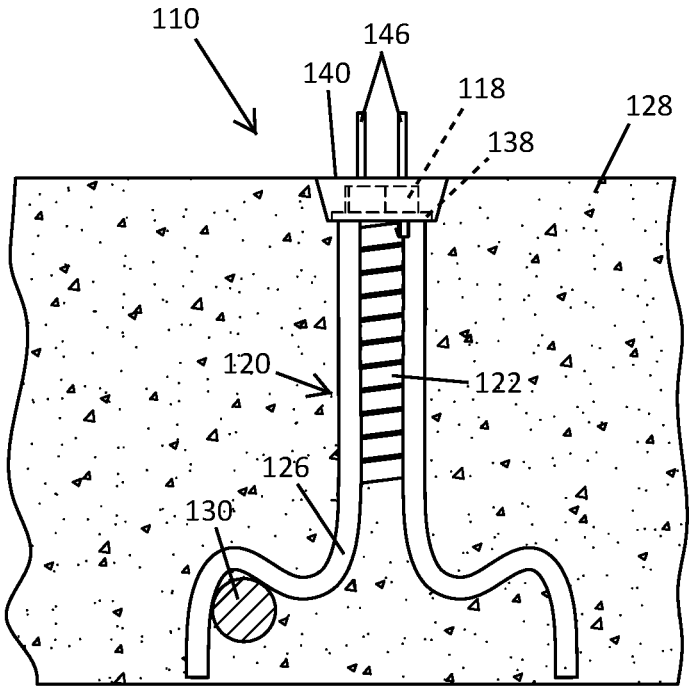
FIG. 11 is a cross-sectional side view of an additional brace insert device.

In an additional example of a brace insert device 110, such as shown in FIG. 11, the hub 122 may have a length that extends to entirely cover the threaded shank portion of the fastener 118 when the fastener 118 is fully threaded into the anchor insert 120, such as when the collar 138 of the fastener 118 is moved into contact with the upper surface of the hub 122. As such, the hub 122 may encase the entire shank portion of the fastener 118, so as to protect the shank portion of the fastener 118 from being affixed to the cast concrete.

Figure 12:
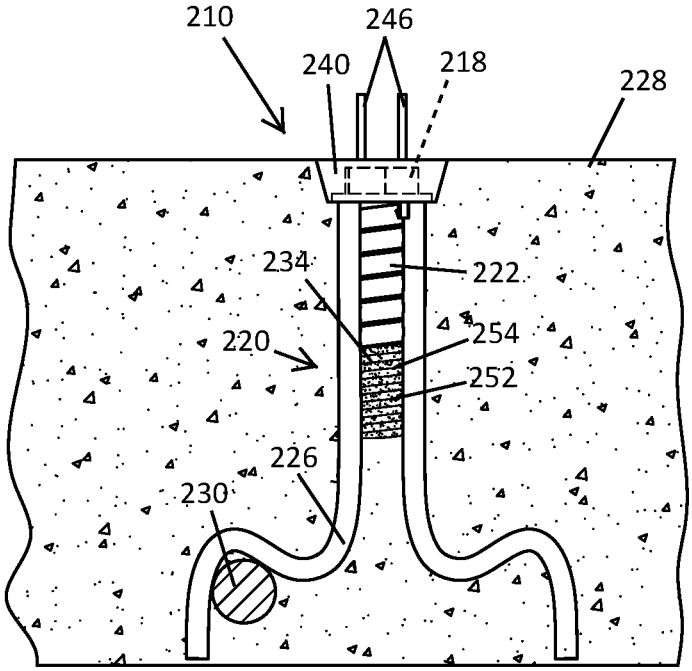
FIG. 12 is a cross-sectional side view of yet another brace insert device.

In yet a further example of a brace insert device 210, such as shown in FIG. 12, a distal end 252 of the shank portion 234 protrudes through the hub 222 and beyond the threaded inner surface of the hub 222. To prevent the distal end 252 of the shank portion 234 from being affixed to the cast concrete, a lubricating substance 254 may be disposed over the distal end 252 prior to being exposed to the liquid concrete. The lubricating substance 254 may be a grease or other oil-based structural bolt lubricant, like stick wax or liquid wax.

Referring now to FIGS. 7-10, the operation and use of the brace insert device 10 will be described. Once the brace insert device 10 is cast in the concrete structure, the locating antenna 46 protrude from the upper surface 28 of the concrete structure, such as shown in FIG. 7. The locating antenna 46 may then be used to locate the brace insert device 10 and may be used to dislodge the cap 40 and pull the cap 40 out of concrete structure, such as shown in FIG. 8. Thus, during the erection process the cap 40 will be located, removed and discarded. The sleeve 54 remains within the panel. Once the cap 40 is removed, a cavity in the upper surface 28 of the concrete is provided around the head portion 36 of the fastener 18. The cavity in the concrete structure that is formed by the cap 40 exposes the head portion 36 of the fastener 18 sufficiently to allow a tool to engage the head portion 36.

Figure 9:
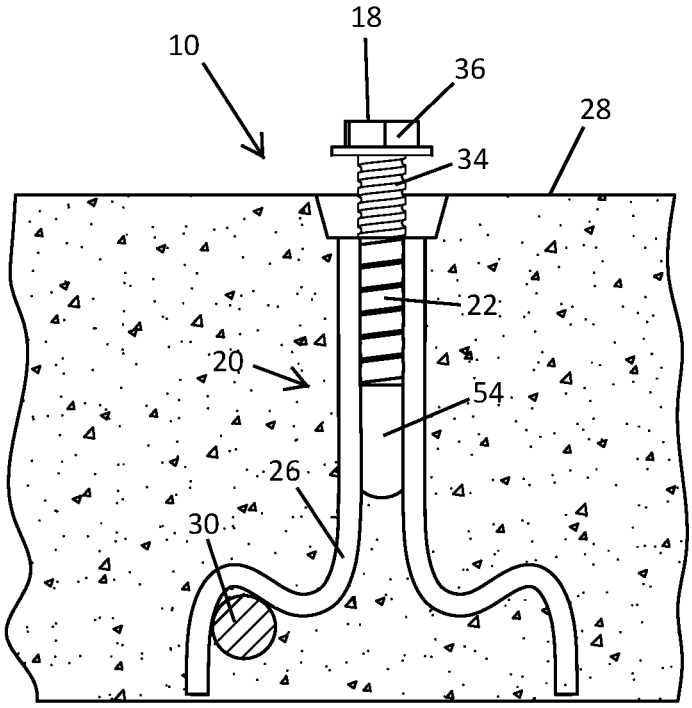
FIG. 9 is a cross-sectional side view of the brace insert device shown in FIG. 8, showing the bolt partially unscrewed to protrude from the concrete structure.
Figure 10:
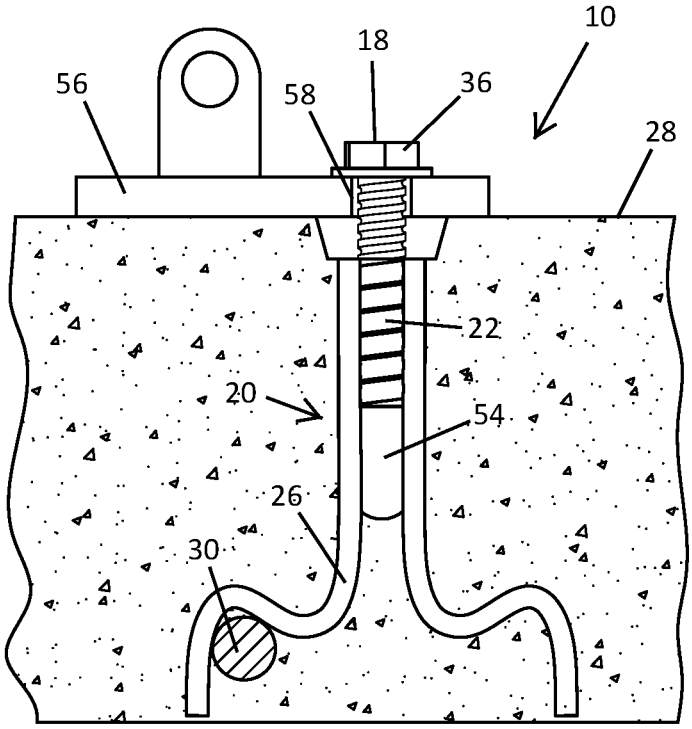
FIG. 10 is a cross-sectional side view of the brace insert device shown in FIG. 9, showing a shoe of a wall brace engaged with the bolt.

The fastener 18 may then be partially unscrewed from the hub 22 to draw the head portion 36 out of the cavity in the surface of the concrete structure to allow for the attachment of a brace shoe 56, such as shown in FIGS. 9 and 10. The fastener 18 is configured to have a length sufficient to remain securely engage with the threaded inner surface 24 of the hub 22 when the fastener 18 is partially unscrewed. The brace shoe 56 of the wall brace 12 may be moved between the head portion 36 of the fastener 18 and the upper surface 28 of the concrete, such as shown in FIG. 10. The fastener 18 may slide into a slot 58 in the brace shoe 56, such that the fastener 18 may remain engaged with the hub 22 of the anchor insert 20 when attaching the brace shoe 56. With the brace shoe 56 placed between the head portion 36 of the fastener 18 and the upper surface 28 of the concrete, the fastener 18 is then tightened down into the hub to secure the brace shoe 56 in place on the concrete structure. Once the Engineer of Record designates that the braces can be removed, the bolts can be fully removed from the panel and patched.

For purposes of this disclosure, the terms "upper," "lower," "right," "left," "rear," "front," "vertical," "horizontal," and derivatives thereof shall relate to the brace insert device as oriented in FIG. 2. However, it is to be understood that the brace insert device may assume various alternative orientations, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A brace insert device configured to be cast in concrete, said brace insert device comprising:

an anchor insert having a hub with a threaded inner surface and a plurality of legs extending directly from the hub, wherein the anchor insert is configured to be cast in a concrete structure;

a bolt having a threaded shank portion with threads that compliment and directly engage with the threaded inner surface of the hub and a head portion fixed to an end of the threaded shank portion, wherein the bolt is configured to be cast in the concrete structure;

a cap disposed over and concealing the head portion of the bolt, wherein the cap is configured to be cast in and subsequently removed from the concrete structure to expose and allow operable access to the head portion of the bolt, wherein the bolt is movable relative to the anchor insert between a casting position and an anchoring position, wherein in the casting position the cap is engaged with the head portion of the bolt and the bolt is engaged within the hub, and wherein, when in the anchoring position the cap is disengaged from the bolt and the bolt is partially unscrewed from the hub to elevate the head portion away from the hub a distance greater than the bolt in the casting position for attaching a wall brace between the head portion of the bolt and an upper surface of the concrete structure; and a sleeve that encloses a distal end of the threaded shank portion of the bolt that protrudes through the hub in the casting position, wherein the sleeve is configured to protect the threaded shank portion of the bolt in the casting position from being exposed to liquid concrete during casting of the concrete structure.

2. The brace insert device of claim 1, wherein the inner surface of the cap comprises a cavity configured to receive the head portion of the bolt.

3. The brace insert device of claim 2, wherein the cavity comprises a hexagonal shape that matably engages the head portion of the bolt.

4. The brace insert device of claim 1, wherein the hub of the anchor insert comprises a coil, and wherein the bolt is configured to engage a shoe portion of the wall brace.

5. The brace insert device of claim 1, wherein the cap comprises an outer surface with at least one locating antenna that is configured to protrude from the concrete structure to locate the cap and the bolt.

6. The brace insert device of claim 5, wherein the cap comprises a tapered sidewall extending between the inner and outer surfaces.

7. The brace insert device of claim 1, wherein the cap comprises at least one connection member that snap-fits to the head portion of the bolt.

8. A brace insert device configured to be cast in concrete, said brace insert device comprising:

an anchor insert having a coil with a threaded inner surface and a plurality of legs extending directly from the coil at a generally equal length, wherein the plurality of legs comprise distal ends that are configured to rest on a lower surface of a concrete form and position the coil away from the lower surface;

a bolt having a threaded shank portion engaged with the threaded inner surface of the coil and a head portion coupled to an end of the threaded shank portion, wherein the bolt is movable in the coil between a casting position configured to be cast in concrete and an anchoring position that is higher than the bolt in the casting position for attaching a brace shoe to the anchor insert cast in concrete;

a cap disposed over the head portion of the bolt in the casting position, wherein the cap is configured to act as a barrier from liquid concrete and to be cast in and subsequently removed from the bolt to allow operable access to the head portion of the bolt, for partially unscrewing the bolt from the coil to the anchoring position; and a sleeve that encloses a distal end of the threaded shank portion of the bolt in the casting position, wherein the sleeve is configured to protect the threaded shank portion of the bolt in the casting position from being exposed to liquid concrete during casting of the concrete.

9. The brace insert device of claim 8, wherein the cap comprises a cavity configured to receive the head portion of the bolt.

10. The brace insert device of claim 9, wherein the cavity comprises a hexagonal shape that matably engages the head portion of the bolt.

11. The brace insert device of claim 8, wherein the coil of the anchor insert comprises a helical shaped wire that provides the threaded inner surface.

12. The brace insert device of claim 8, wherein the sleeve comprises a polymeric shell that configured to act as a barrier from liquid concrete contacting the exposed end section of the threaded shank portion.

13. The brace insert device of claim 8, wherein the cap comprises at least one locating antenna that extends away from the head portion of the bolt and is configured to protrude from the concrete to locate the cap cast in the concrete.

14. The brace insert device of claim 8, wherein the cap comprises a tapered sidewall that is configured to permit removal of the cap from the concrete without damaging concrete surfaces surrounding the bolt.

15. The brace insert device of claim 8, wherein the bolt, when partially unscrewed from the coil, is configured to engage a shoe portion of the wall brace.

16. A brace insert device configured to be cast in concrete, said brace insert device comprising:

an anchor insert having a hub and a plurality of legs extending directly from the hub, wherein the anchor insert is configured to be cast in a concrete structure;

a bolt having a threaded shank portion with threads that compliment and directly engage with a threaded inner surface that surround an aperture of the hub, wherein the bolt is configured to be cast in the concrete structure with the anchor insert;

a cap disposed over a head portion of the bolt during casting in the concrete structure with the anchor insert and the bolt, wherein the cap comprises at least one locating antenna that is configured to protrude from the concrete structure to locate the cap, and wherein the cap is configured to be cast in and subsequently removed from the concrete structure to expose and allow operable access to the head portion of the fastener for use in attaching the concrete structure to a wall brace; and a sleeve that encloses a distal end of the threaded shank portion of the bolt that protrudes through the hub during casting, wherein the sleeve is configured to protect the threaded shank portion of the bolt from being exposed to liquid concrete during casting of the concrete structure.

17. The brace insert device of claim 16, wherein an inner surface of the cap comprises a cavity with a shape that matably engages the head portion of the bolt.

* * * * *